US011286797B2

(12) United States Patent
Hunnewell et al.

(10) Patent No.: US 11,286,797 B2
(45) Date of Patent: Mar. 29, 2022

(54) GAS TURBINE ENGINE STATOR VANE BASE SHAPE

(71) Applicant: United Technologies Corporation, Farmington, CT (US)

(72) Inventors: Nicholas Hunnewell, North Berwick, ME (US); Michael J. Martel, Saco, ME (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 562 days.

(21) Appl. No.: 16/001,187

(22) Filed: Jun. 6, 2018

(65) Prior Publication Data

US 2019/0376397 A1 Dec. 12, 2019

(51) Int. Cl.
*F01D 9/04* (2006.01)

(52) U.S. Cl.
CPC ..... *F01D 9/042* (2013.01); *F01D 9/041* (2013.01); *F05D 2230/60* (2013.01); *F05D 2240/12* (2013.01)

(58) Field of Classification Search
CPC ..... F01D 9/042
See application file for complete search history.

(56) References Cited

U.S. PATENT DOCUMENTS

| | | | | |
|---|---|---|---|---|
| 2,917,276 | A * | 12/1959 | Klompas | F01D 9/042 415/189 |
| 2,962,256 | A * | 11/1960 | Bishop | F01D 11/18 415/136 |
| 3,004,750 | A | 10/1961 | Broders | |
| 6,296,442 | B1 | 10/2001 | Tran | |
| 6,543,995 | B1 * | 4/2003 | Honda | F01D 9/041 415/189 |
| 8,926,262 | B2 * | 1/2015 | Tanahashi | F01D 5/282 415/9 |
| 9,068,464 | B2 * | 6/2015 | Morrison | F01D 5/282 |
| 9,726,028 | B2 * | 8/2017 | Marra | F01D 9/042 |
| 9,803,486 | B2 * | 10/2017 | Freeman | F01D 5/189 |
| 2014/0301840 | A1 * | 10/2014 | Hein | F01D 9/042 415/209.3 |
| 2019/0063246 | A1 * | 2/2019 | Frey | C04B 37/001 |

* cited by examiner

*Primary Examiner* — Woody A Lee, Jr.
(74) *Attorney, Agent, or Firm* — Cantor Colburn LLP

(57) ABSTRACT

A stator assembly for use in a gas turbine engine is provided. The stator assembly including: a conical stator shroud including a radially inward surface and a radially outward surface opposite the radially inward surface; and a plurality of stator vanes integrally attached to the conical stator shroud, each of the plurality of stator vanes being integrally attached to the conical stator shroud at a base of the stator vane, wherein radially outward surface of the base of the stator vane mates flush with the radially inward surface of the conical stator shroud.

18 Claims, 8 Drawing Sheets

GAS TURBINE ENGINE STATOR VANE BASE SHAPE

BACKGROUND

The subject matter disclosed herein generally relates to gas turbine engines and, more particularly, to a guide vanes of gas turbine engines.

The gas turbine engine may include a core that is supported by a case. The core may include stator vanes that are supported by the case to limit displacement of the stator vanes. The stator vanes are subjected to high pressures, high temperatures, and vibrations that may be transmitted to the case.

SUMMARY

According to one embodiment, a stator assembly for use in a gas turbine engine is provided. The stator assembly including: a conical stator shroud including a radially inward surface and a radially outward surface opposite the radially inward surface; and a plurality of stator vanes integrally attached to the conical stator shroud, each of the plurality of stator vanes being integrally attached to the conical stator shroud at a base of the stator vane, wherein radially outward surface of the base of the stator vane mates flush with the radially inward surface of the conical stator shroud.

In addition to one or more of the features described above, or as an alternative, further embodiments may include that the radially outward surface of the base of the guide vane is shaped to create line-to-line surface contact between the radially outward surface of the base of the guide vane and the radially inward surface of the conical stator shroud.

In addition to one or more of the features described above, or as an alternative, further embodiments may include that the radially outward surface of the base of the guide vane and the radially inward surface of the conical stator shroud are opposite congruent shapes, such that when the radially outward surface of the base of the guide vane is the radially inward surface of the conical stator shroud there are no overlaps or gaps between the radially outward surface of the base of the guide vane and the radially inward surface of the conical stator shroud.

In addition to one or more of the features described above, or as an alternative, further embodiments may include: a plurality of fastening mechanism configured to securely fasten the base of each of the plurality of stator vanes to the conical stator shroud.

In addition to one or more of the features described above, or as an alternative, further embodiments may include that each of the plurality of fastening mechanisms is a rivet.

In addition to one or more of the features described above, or as an alternative, further embodiments may include that the conical stator shroud has a conical frustum shape.

According to another embodiment, a method of manufacturing a stator assembly for use in a gas turbine engine is provided. The method including: inserting a stator vane into a vane slot in a radially inward surface of a conical stator shroud; moving the stator vane through the vane slot such that the stator vane projects out of the vane slot from a radially outward surface the conical stator shroud; and securely attaching the stator vane to the conical stator shroud at a base of the stator vane, such that a radially outward surface of the base of the stator vane mates flush with the radially inward surface of the conical stator shroud.

In addition to one or more of the features described above, or as an alternative, further embodiments may include that the radially outward surface of the base of the guide vane is shaped to create line-to-line surface contact between the radially outward surface of the base of the guide vane and the radially inward surface of the conical stator shroud.

In addition to one or more of the features described above, or as an alternative, further embodiments may include that the radially outward surface of the base of the guide vane and the radially inward surface of the conical stator shroud are opposite congruent shapes, such that when the radially outward surface of the base of the guide vane is the radially inward surface of the conical stator shroud there are no overlaps or gaps between the radially outward surface of the base of the guide vane and the radially inward surface of the conical stator shroud.

In addition to one or more of the features described above, or as an alternative, further embodiments may include that a plurality of fastening mechanism are configured to securely fasten the base the stator vane to the conical stator shroud.

In addition to one or more of the features described above, or as an alternative, further embodiments may include that each of the plurality of fastening mechanisms is a rivet.

In addition to one or more of the features described above, or as an alternative, further embodiments may include that the conical stator shroud has a conical frustum shape.

According to another embodiment, a gas turbine engine is provided. The gas turbine engine including: a compressor section; a turbine section; a stator vane assembly located in at least one of the compressor section and the turbine section, the stator vane assembly including: a conical stator shroud including a radially inward surface and a radially outward surface opposite the radially inward surface; and a plurality of stator vanes integrally attached to the conical stator shroud, each of the plurality of stator vanes being integrally attached to the conical stator shroud at a base of the stator vane, wherein radially outward surface of the base of the stator vane mates flush with the radially inward surface of the conical stator shroud.

In addition to one or more of the features described above, or as an alternative, further embodiments may include that the radially outward surface of the base of the guide vane is shaped to create line-to-line surface contact between the radially outward surface of the base of the guide vane and the radially inward surface of the conical stator shroud.

In addition to one or more of the features described above, or as an alternative, further embodiments may include that the radially outward surface of the base of the guide vane and the radially inward surface of the conical stator shroud are opposite congruent shapes, such that when the radially outward surface of the base of the guide vane is the radially inward surface of the conical stator shroud there are no overlaps or gaps between the radially outward surface of the base of the guide vane and the radially inward surface of the conical stator shroud.

In addition to one or more of the features described above, or as an alternative, further embodiments may include: a plurality of fastening mechanism configured to securely fasten the base of each of the plurality of stator vanes to the conical stator shroud.

In addition to one or more of the features described above, or as an alternative, further embodiments may include that each of the plurality of fastening mechanisms is a rivet.

In addition to one or more of the features described above, or as an alternative, further embodiments may include that the conical stator shroud has a conical frustum shape.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

Figure 1:
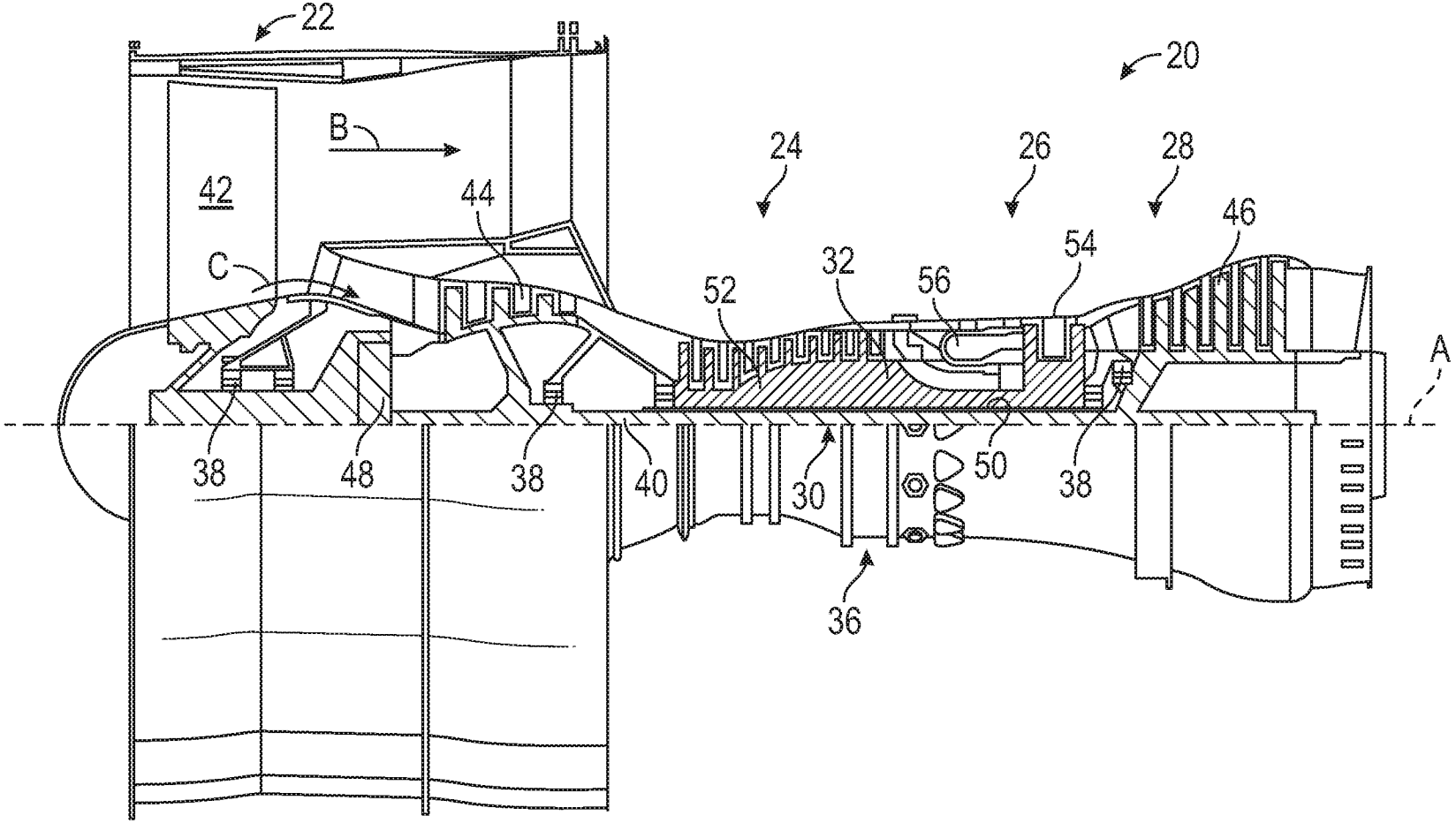
FIG. 1 is a partial cross-sectional illustration of a gas turbine engine, in accordance with an embodiment of the disclosure.
Figure 6:
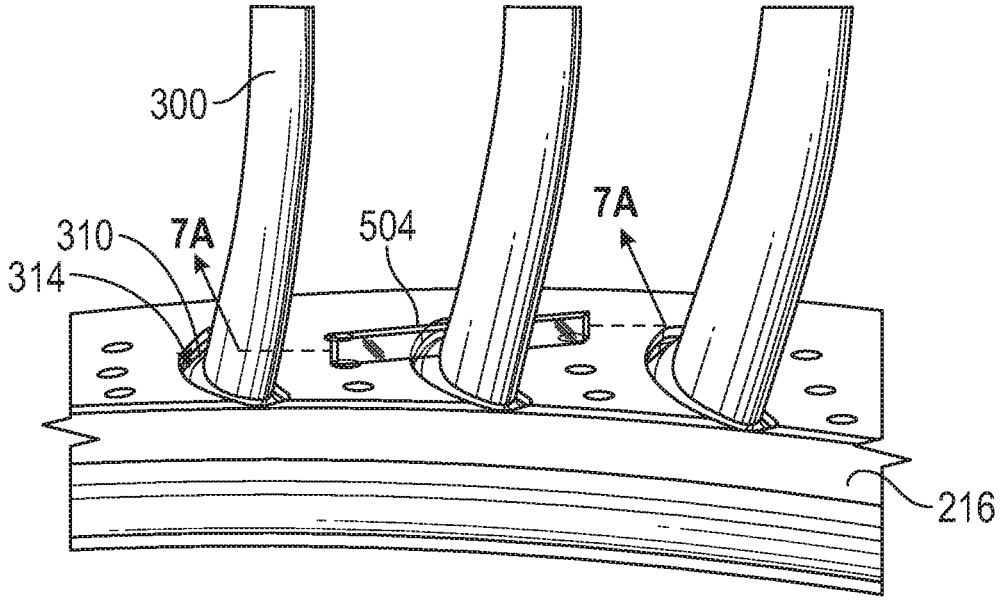
FIG. 6 is an enlarged view of the stator assembly of FIG. 2, in accordance with an embodiment of the disclosure.
Figure 7A:
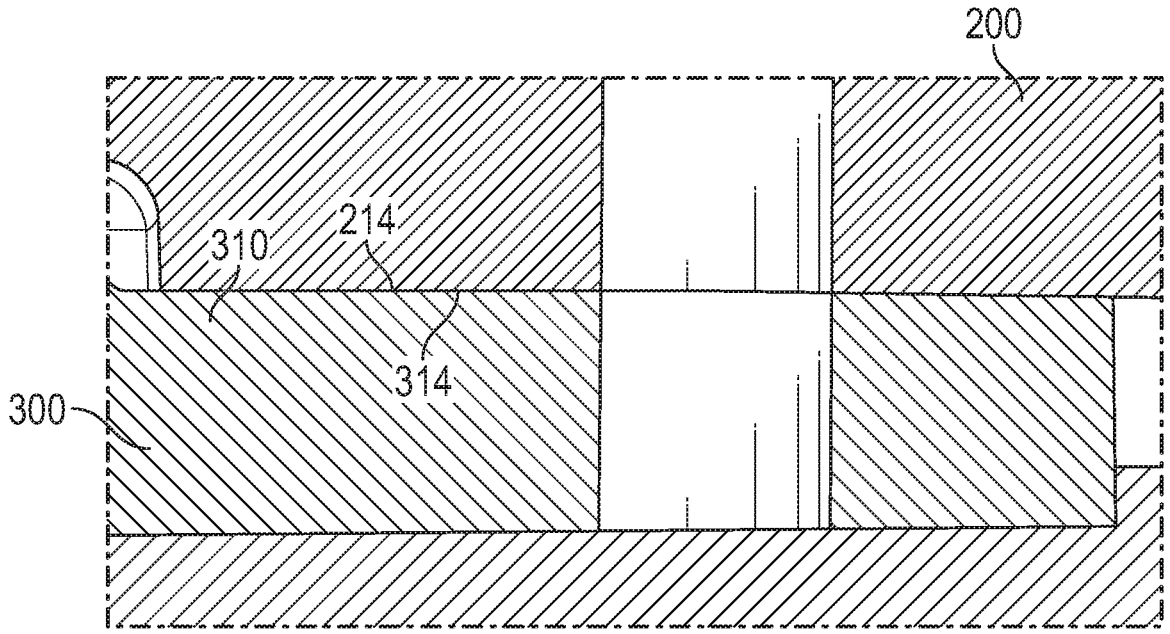
Figure 7B:
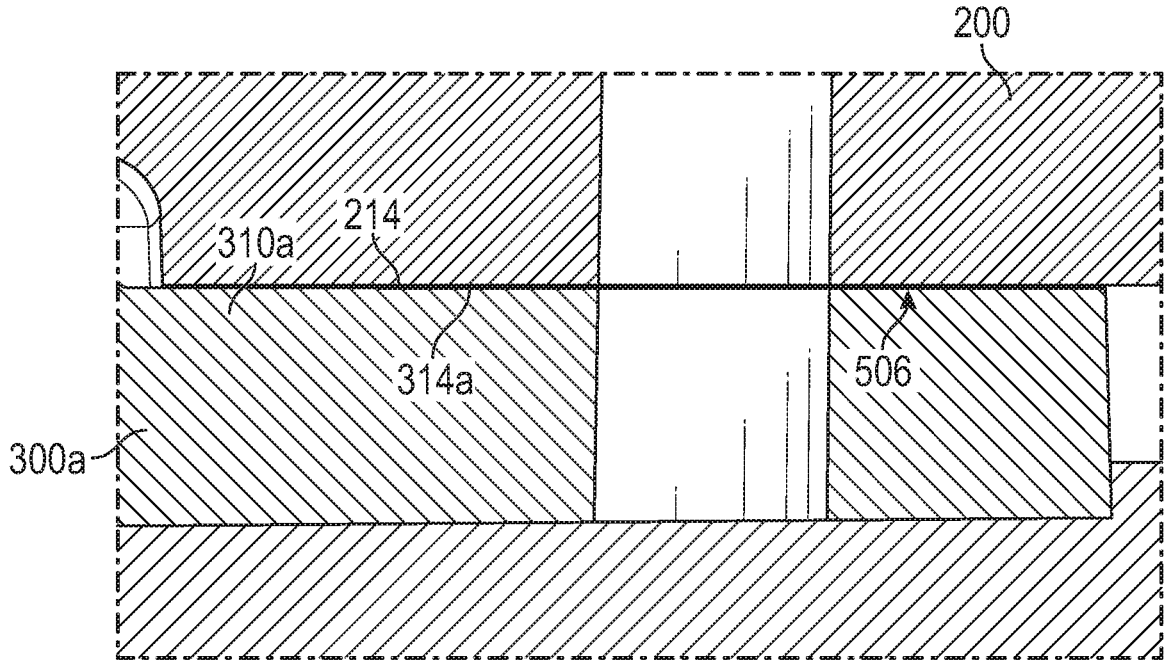
Figure 8:
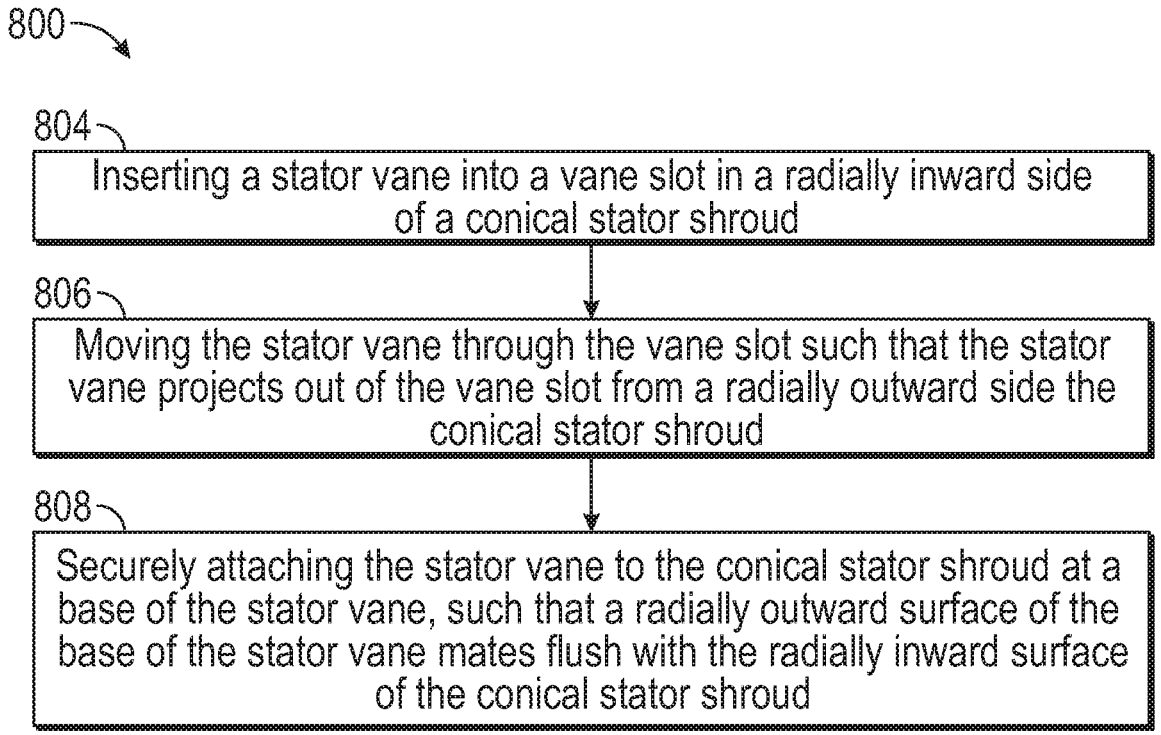

FIG. 7*a* is a cross-sectional view of the stator assembly of FIG. 6, in accordance with an embodiment of the disclosure;

FIG. 7*b* is a cross-sectional view of the stator assembly of FIG. 6, where a base of the stator vane includes a flat radially outward surface, in accordance with an embodiment of the disclosure; and FIG. 8 is an illustration of a method of manufacturing a stator assembly for use in a gas turbine engine of FIG. 1, in accordance with an embodiment of the disclosure.

The detailed description explains embodiments of the present disclosure, together with advantages and features, by way of example with reference to the drawings.

DETAILED DESCRIPTION

A detailed description of one or more embodiments of the disclosed apparatus and method are presented herein by way of exemplification and not limitation with reference to the Figures.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

Figure 2:
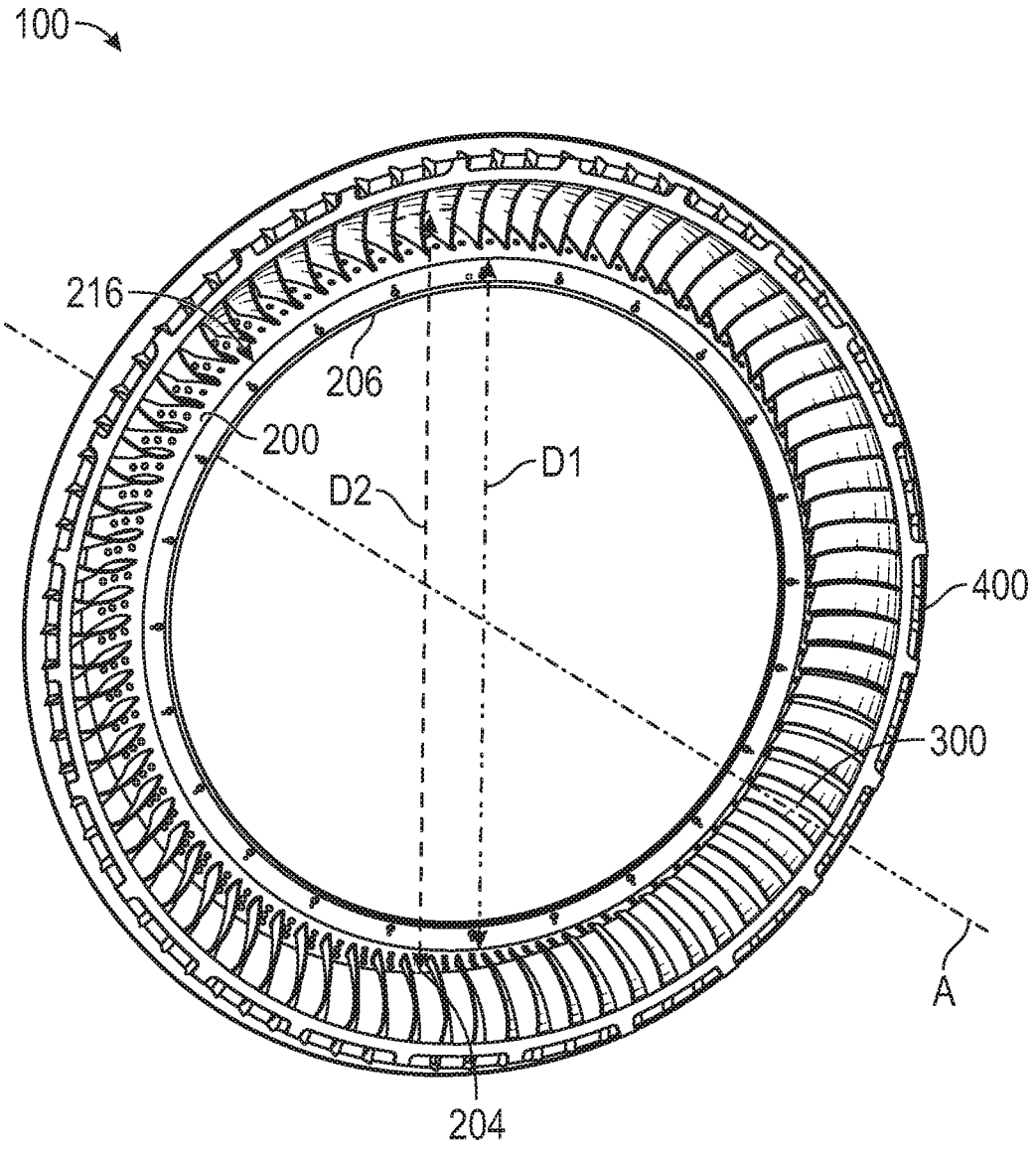
FIG. 2 is an isometric view of a stator assembly for use in a gas turbine engine of FIG. 1, in accordance with an embodiment of the disclosure.

Referring now to FIGS. 2-6, and 7*a*-7*b* with continued reference to FIG. 1, a stator assembly 100 is shown. The stator vane assembly 100 may be located in at least one of the compressor section 24 and the turbine section 28 of the gas turbine engine 20 of FIG. 1. The stator vane assembly 100 may be circumferentially arranged about the longitudinal axis A. The stator vane assembly 100 may be supported by a case that is disposed about the core of the gas turbine engine 20. As illustrated in FIG. 2, the stator assembly 100 includes a conical stator shroud 200, a plurality of stator vanes 300 integrally attached to the conical stator shroud 200, and an outer vane support 400. As shown in FIG. 2, the conical stator shroud 200 may be conical frustum in shape having a central orifice 206. Further, an inner diameter D1 of a first side 202 of the conical stator shroud 200 may be less than an inner diameter D2 of a second side 204 of the conical stator shroud 200 opposite the first side 202, thus producing the conical frustum shape.

Figure 3:
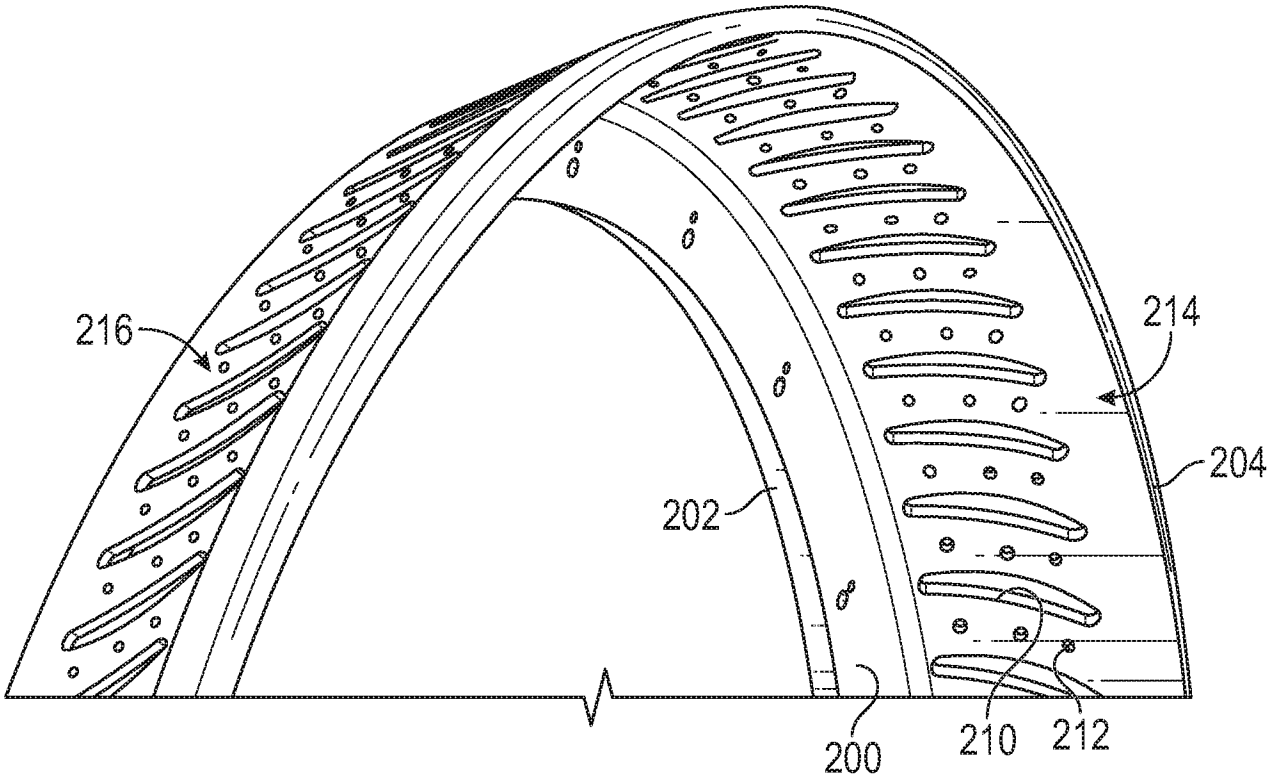
FIG. 3 is an isometric view of a conical stator shroud of the stator assembly of FIG. 2, in accordance with an embodiment of the disclosure.

As shown in FIG. 3, the conical stator shroud 200 may include vane slots 210 configured to allow the guide vane 300 to be inserted through the vane slots 210. The conical stator shroud 200 may also include a plurality of pre-formed (e.g., predrilled) fastener holes 212 configured to allow a fastener to be inserted through the fastener holes 212. In an embodiment, there may be three preformed fastener holes 212 per vane slot 210.

A guide vane 300 is inserted through the vane slot 210 at a radially inward surface 214 of the conical stator shroud 200 and then projects away from a radially outward surface 216 of the conical stator shroud 200 towards the outer vane support 400.

Figure 4:
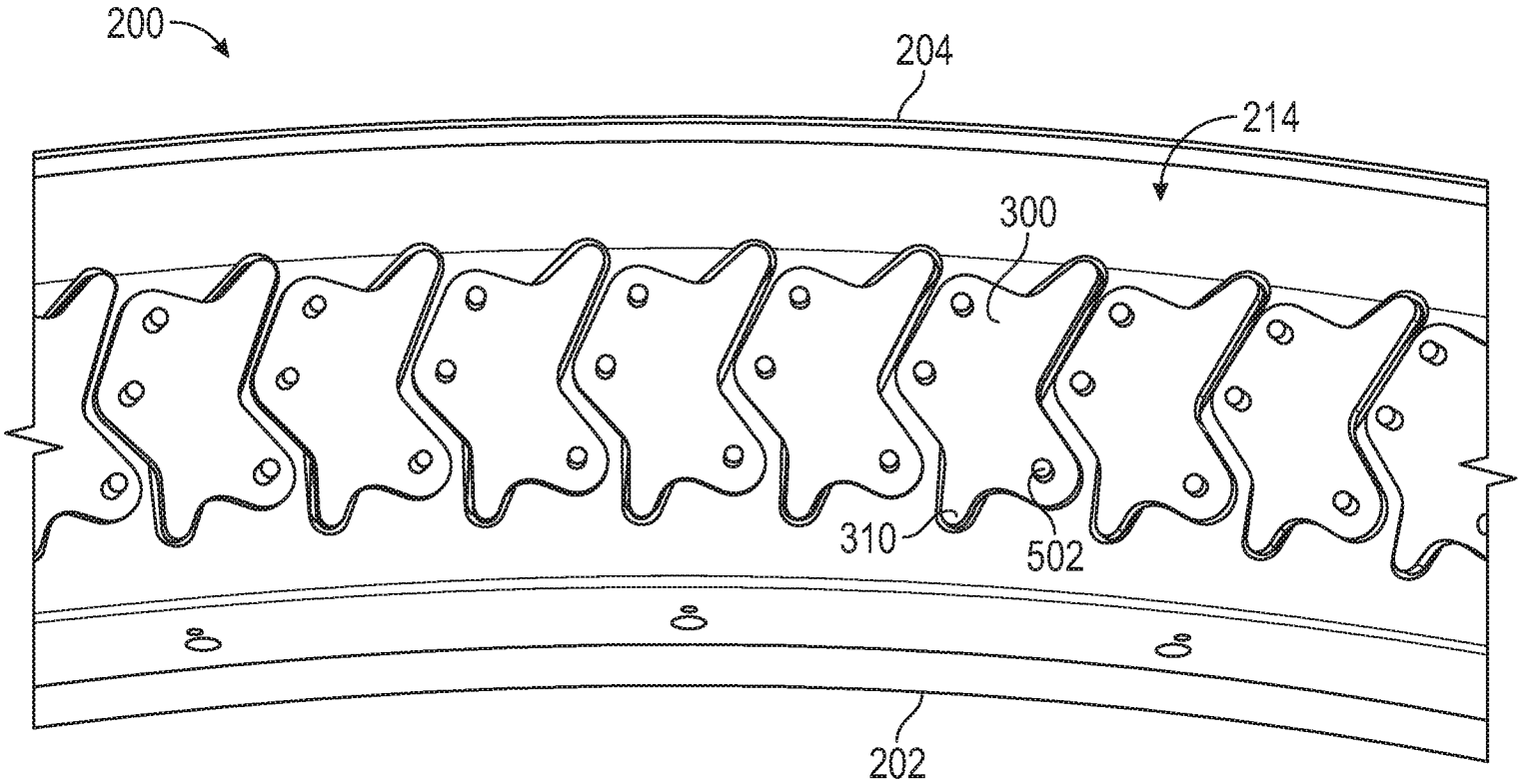
FIG. 4 is an illustration of a radially inward surface of the conical stator shroud of FIG. 3, in accordance with an embodiment of the disclosure.

A shown in FIG. 4, once the guide vane 300 is fully inserted through the vane slot 210 at the radially inward surface 214 of the conical stator shroud 200, then a base 310 of the guide vane 300 may be securely fastened to the conical stator shroud 200 by a plurality of fastening mechanisms 502. The fastening mechanism 502 may be a rivet, bolt, weld, or any other fastening mechanism know to one skill in the art. In an embodiment, the fastening mechanism 502 is a rivet. In an embodiment, the base 310 of the guide vane 310 may be securely fastened to the conical stator shroud 200 by three fastening mechanism 502, as shown in FIG. 4

Figure 5:
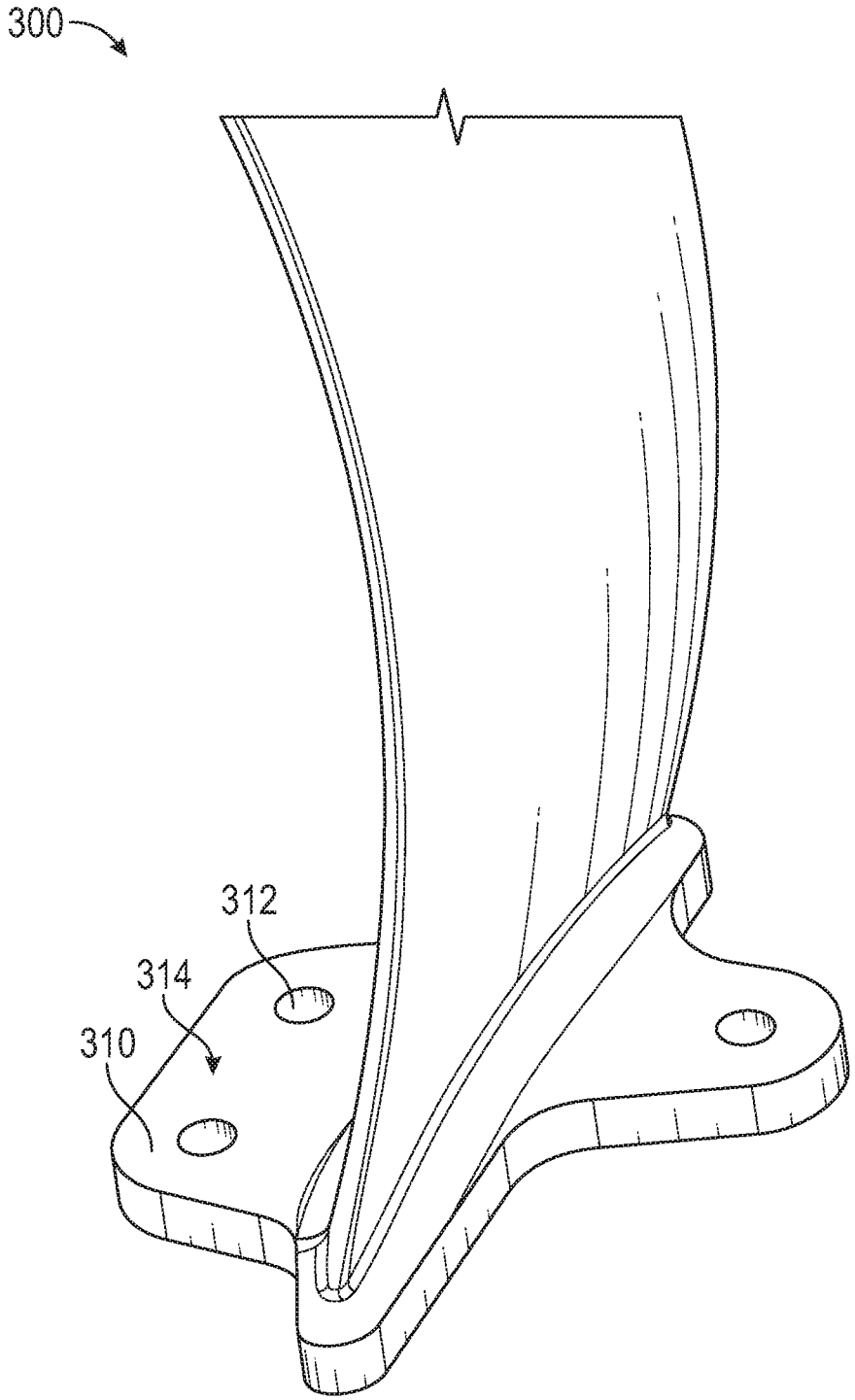
FIG. 5 is an isometric view of a guide vane of the stator assembly of FIG. 2, in accordance with an embodiment of the disclosure.

As shown in FIG. 5, the base 310 of the guide vane 300 may include a plurality of pre-formed (e.g., predrilled) fastener holes 312 configured to allow a fastener 502 to be inserted through the fastener holes 312. In an embodiment, there may be three preformed fastener holes 312 in the base 310 of the guide vane 300. A radially outward surface 314 of the base 310 of the guide vane 300 is configured to mate flush with the radially inward surface 214 of the conical stator shroud 200. In an embodiment, the radially outward surface 314 of the base 310 of the guide vane 300 is shaped to create line-to-line surface contact between the radially outward surface 314 of the base 310 of the guide vane 300 and the radially inward surface 214 of the conical stator shroud 200.

In another embodiment, the radially outward surface 314 of the base 310 of the guide vane 300 and the radially inward surface 214 of the conical stator shroud 200 are opposite congruent shapes, such that when the radially outward surface 314 of the base 310 of the guide vane 300 is the radially inward surface 214 of the conical stator shroud 200 there are no overlaps or gaps between the radially outward surface 314 of the base 310 of the guide vane 300 and the radially inward surface 214 of the conical stator shroud 200.

The interface between the radially outward surface 314 of the base 310 of the guide vane 300 and the radially inward surface 214 of the conical stator shroud 200 is more clearly visible by examining the view plane 504 illustrated in FIG. 6.

FIGS. 7*a* and 7*b* illustrate the interface between the radially outward surface 314 of the base 310 of the guide vane 300 and the radially inward surface 214 of the conical stator shroud 200. In FIG. 7*a*, the radially outward surface 314 of the base 310 of the guide vane 300 is shaped to create line-to-line surface contact between the radially outward surface 314 of the base 310 of the guide vane 300 and the radially inward surface 214 of the conical stator shroud 200, thus there are no overlaps or gaps between the radially outward surface 314 of the base 310 of the guide vane 300 and the radially inward surface 214 of the conical stator shroud 200.

FIG. 7*b* illustrates an example if a guide vane 300*a* with a flat base 310*a* were to be used as opposed to a guide vane 300 with a conical shape base 310 shaped to create line-to-line surface contact between the radially outward surface 314 of the base 310 of the guide vane 300 and the radially inward surface 214 of the conical stator shroud 200. If a radially outward surface 314*a* of a base 310*a* of a guide vane 300*a* is flat in shape, a gap 506 is created between the radially outward surface 314*a* of the base 310*a* of the guide vane 300*a* and the radially inward surface 214 of the conical stator shroud 200. The gap 506 may vary in size based upon the sequence that the fastener mechanisms 502 are secured. The gap 506 may also vary in size based upon the orientation of the guide vane 300*a* relative to the radially inward surface 214 of the conical stator shroud 200, when the fastener mechanisms 502 are secured. The existence of the gap 506 between the radially outward surface 314*a* of the base 310*a* of the guide vane 300*a* and the radially inward surface 214 of the conical stator shroud 200 may create unintended stress on the fastening mechanisms 502, the guide vanes 300, and/or the conical stator shroud 200.

Advantageously, utilizing a guide vane 300 with a radially outward surface 314 of the base 310 of the guide vane 300 shaped to mate flush with the radially inward surface 214 of the conical stator shroud 200 prevents the gap 506 and thus eliminates the need to fasten the fastening mechanisms 502 in a particular sequence or fasten the fastening mechanisms 502 when the guide vane 300 and the conical stator shroud 200 are oriented in a particular manner.

Referring now to FIG. 7 with continued reference to FIGS. 1-6 and 7*a*-7*b*. FIG. 8 illustrates a method 800 of manufacturing a stator assembly 100 for use in a gas turbine engine 20. At block 804, a stator vane 300 is inserted into a vane slot 200 in a radially inward surface 214 of a conical stator shroud 200. At block 806, the stator vane 300 is moved through the vane slot 210 such that the stator vane 300 projects out of the vane slot 210 from a radially outward surface 216 the conical stator shroud 200. At block 808, the stator vane 300 is securely attached to the conical stator shroud 200 at a base 310 of the stator vane 300, such that a radially outward surface 314 of the base 310 of the stator vane 300 mates flush with the radially inward surface 214 of the conical stator shroud 200.

While the above description has described the flow process of FIG. 8 in a particular order, it should be appreciated that unless otherwise specifically required in the attached claims that the ordering of the steps may be varied.

Technical effects of embodiments of the present disclosure include utilizing a stator vane having a base shaped to match a mating surfaces of the conical stator shroud that supports that stator vane.

The term "about" is intended to include the degree of error associated with measurement of the particular quantity based upon the equipment available at the time of filing the application. For example, "about" can include a non-limiting range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A stator assembly for use in a gas turbine engine, the stator assembly comprising:

a conical stator shroud including a radially inward surface and a radially outward surface opposite the radially inward surface, the radially inward surface being curved in shape, wherein the conical stator shroud comprises a vane slot; and a stator vane integrally attached to the conical stator shroud, the stator vane comprising a base having a radially outward surface, wherein the stator vane is integrally attached to the conical stator shroud at a base of the stator vane, wherein the radially outward surface of the base of the stator vane is shaped to mate flush with the radially inward surface of the conical stator shroud prior to the stator vane being integrally attached to the conical stator shroud, and wherein the stator vane is configured to be inserted through the vane slot until the base mounts flush to the conical stator shroud without compression between the vane slot and the stator vane in the installed state and then be integrally attached to the conical stator shroud.

2. The stator assembly of claim 1, wherein the radially outward surface of the base of the guide vane is shaped to create line-to-line surface contact between the radially outward surface of the base of the guide vane and the radially inward surface of the conical stator shroud.

3. The stator assembly of claim 1, wherein the radially outward surface of the base of the guide vane and the radially inward surface of the conical stator shroud are opposite congruent shapes, such that when the radially outward surface of the base of the guide vane is the radially inward surface of the conical stator shroud there are no overlaps or gaps between the radially outward surface of the base of the guide vane and the radially inward surface of the conical stator shroud.

4. The stator assembly of claim 1, further comprising:

a plurality of fastening mechanism configured to securely fasten the base of the stator vane to the conical stator shroud.

5. The stator assembly of claim 4, wherein each of the plurality of fastening mechanisms is a rivet.

6. The stator assembly of claim 1, wherein the conical stator shroud has a conical frustum shape.

7. A method of manufacturing a stator assembly for use in a gas turbine engine, the method comprising:

inserting a stator vane into a vane slot in a radially inward surface of a conical stator shroud without compression between the vane slot and the stator vane in the installed state, the radially inward surface being curved in shape;

moving the stator vane through the vane slot until the base mounts flush to the conical stator shroud without compression between the vane slot and the stator vane in the installed state, wherein the stator vane projects out of the vane slot from a radially outward surface the conical stator shroud; and securely attaching the stator vane to the conical stator shroud at a base of the stator vane, such that a radially outward surface of the base of the stator vane mates flush with the radially inward surface of the conical stator shroud, wherein the radially outward surface of the base of the stator vane is shaped to mate flush with the radially inward surface of the conical stator shroud prior to the stator vane being integrally attached to the conical stator shroud.

8. The method of claim 7, wherein the radially outward surface of the base of the guide vane is shaped to create line-to-line surface contact between the radially outward surface of the base of the guide vane and the radially inward surface of the conical stator shroud.

9. The method of claim 7, wherein the radially outward surface of the base of the guide vane and the radially inward surface of the conical stator shroud are opposite congruent shapes, such that when the radially outward surface of the base of the guide vane is the radially inward surface of the conical stator shroud there are no overlaps or gaps between the radially outward surface of the base of the guide vane and the radially inward surface of the conical stator shroud.

10. The method of claim 7, wherein a plurality of fastening mechanism are configured to securely fasten the base the stator vane to the conical stator shroud.

11. The method of claim 10, wherein each of the plurality of fastening mechanisms is a rivet.

12. The method of claim 7, wherein the conical stator shroud has a conical frustum shape.

13. A gas turbine engine, comprising:

a compressor section;

a turbine section;

a stator vane assembly located in at least one of the compressor section and the turbine section, the stator vane assembly comprising:

a conical stator shroud including a radially inward surface and a radially outward surface opposite the radially inward surface, the radially inward surface being curved in shape, wherein the conical stator shroud comprises a vane slot; and a vane integrally attached to the conical stator shroud, the stator vane comprising a base having a radially outward surface, wherein the stator vane is integrally attached to the conical stator shroud at the base of the stator vane, wherein the radially outward surface of the base of the stator vane is shaped to mate flush with the radially inward surface of the conical stator shroud prior to each of the stator vane being integrally attached to the conical stator shroud, and wherein the stator vane is configured to be inserted through the vane slot until the base mounts flush to the conical stator shroud without compression between the vane slot and the stator vane in the installed state and then be integrally attached to the conical stator shroud.

14. The gas turbine engine of claim 13, wherein the radially outward surface of the base of the guide vane is shaped to create line-to-line surface contact between the radially outward surface of the base of the guide vane and the radially inward surface of the conical stator shroud.

15. The gas turbine engine of claim 13, wherein the radially outward surface of the base of the guide vane and the radially inward surface of the conical stator shroud are opposite congruent shapes, such that when the radially outward surface of the base of the guide vane is the radially inward surface of the conical stator shroud there are no overlaps or gaps between the radially outward surface of the base of the guide vane and the radially inward surface of the conical stator shroud.

16. The gas turbine engine of claim 13, further comprising:

a plurality of fastening mechanism configured to securely fasten the base of the stator vane to the conical stator shroud.

17. The gas turbine engine of claim 16, wherein each of the plurality of fastening mechanisms is a rivet.

18. The gas turbine engine of claim 13, wherein the conical stator shroud has a conical frustum shape.

* * * * *